US006651472B2

(12) United States Patent
Chebbi

(10) Patent No.: US 6,651,472 B2
(45) Date of Patent: Nov. 25, 2003

(54) PRECISION PRESS BRAKE

(75) Inventor: Brahim Chebbi, Montrouge (FR)

(73) Assignee: Amada Europe, Tremblay (FR)

( * ) Notice: Subject to any disclaimer, the term of this patent is extended or adjusted under 35 U.S.C. 154(b) by 0 days.

(21) Appl. No.: 10/300,793

(22) Filed: Nov. 21, 2002

(65) Prior Publication Data

US 2003/0069662 A1 Apr. 10, 2003

Related U.S. Application Data

(62) Division of application No. 09/600,166, filed as application No. PCT/FR00/01991 on Jul. 10, 2000.

(30) Foreign Application Priority Data

Jul. 13, 1999 (FR) ..... 99 09077

(51) Int. Cl.[7] ..... B21C 51/00; B21D 5/02; G05B 19/18

(52) U.S. Cl. ..... 72/31.1; 72/31.11; 72/17.3; 72/21.5; 72/389.3; 72/702

(58) Field of Search ..... 72/31.1, 21.5, 72/17.3, 389.3, 389.5, 702, 31.11, 31.01

(56) References Cited

U.S. PATENT DOCUMENTS

| | | | | |
|---|---|---|---|---|
| 4,430,879 A | | 2/1984 | Rolland | 72/389.3 |
| 4,486,841 A | | 12/1984 | Koyama et al. | 72/21 |
| 4,488,237 A | | 12/1984 | Aronson et al. | 364/476 |
| 4,564,765 A | | 1/1986 | Blaich | 250/561 |
| 4,640,113 A | | 2/1987 | Dieperink et al. | 72/21 |
| 4,864,509 A | | 9/1989 | Somerville et al. | 364/476 |
| 5,099,666 A | | 3/1992 | Sartorio et al. | 72/12 |
| 5,148,693 A | | 9/1992 | Sartorio et al. | 72/12 |
| 5,307,659 A | | 5/1994 | Sartorio | 72/7 |
| 5,329,597 A | | 7/1994 | Kouno et al. | 382/8 |
| 5,483,750 A | * | 1/1996 | Ooenoki et al. | 72/389.3 |
| 5,497,647 A | | 3/1996 | Nagakura | 72/389.3 |
| 5,704,238 A | * | 1/1998 | Tokai | 72/31.11 |
| 5,812,406 A | | 9/1998 | Matsomoto et al. | 72/389.3 |
| 5,839,310 A | | 11/1998 | Tokai et al. | 72/31.1 |
| 5,842,366 A | | 12/1998 | Klingel et al. | 72/31.1 |
| 5,857,366 A | | 1/1999 | Koyama | 72/31.1 |
| 5,980,085 A | | 11/1999 | Uemura et al. | 700/97 |
| 6,003,353 A | * | 12/1999 | Ootani et al. | 72/31.1 |
| 6,035,242 A | | 3/2000 | Uemura et al. | 364/468.03 |
| 6,038,899 A | * | 3/2000 | Nagasawa | 72/14.8 |
| 6,161,408 A | | 12/2000 | Ooenoki et al. | 72/31.01 |
| 6,298,700 B2 | * | 10/2001 | Nagasawa | 72/14.8 |

FOREIGN PATENT DOCUMENTS

| | | |
|---|---|---|
| DE | 3441113 | 5/1986 |
| EP | 0166351 | 1/1986 |
| FR | 2526158 | 11/1983 |
| FR | 2654369 | 5/1991 |
| JP | 60247415 | 12/1985 |
| WO | 99/14641 | 3/1999 |

* cited by examiner

*Primary Examiner*—David Jones
(74) *Attorney, Agent, or Firm*—Greenblum & Bernstein, P.L.C.

(57) ABSTRACT

A numerical control device for a bending machine includes a keyboard, a memory and a processor. The memory stores one or more groups of data, each containing bending conditions, a bend angle and at least one penetration depth. The memory further stores program instructions for searching whether data input with the keyboard is stored in the memory, in a same group of data, and that sends a signal to the bending machine so that the bending machine peforms bending according to the penetration depth included in the group of data. The processor that executes said program instructions.

17 Claims, 11 Drawing Sheets

(PROGRAMMING PROCEDURE)

(PROGRAMMING PROCEDURE)

FIG.11
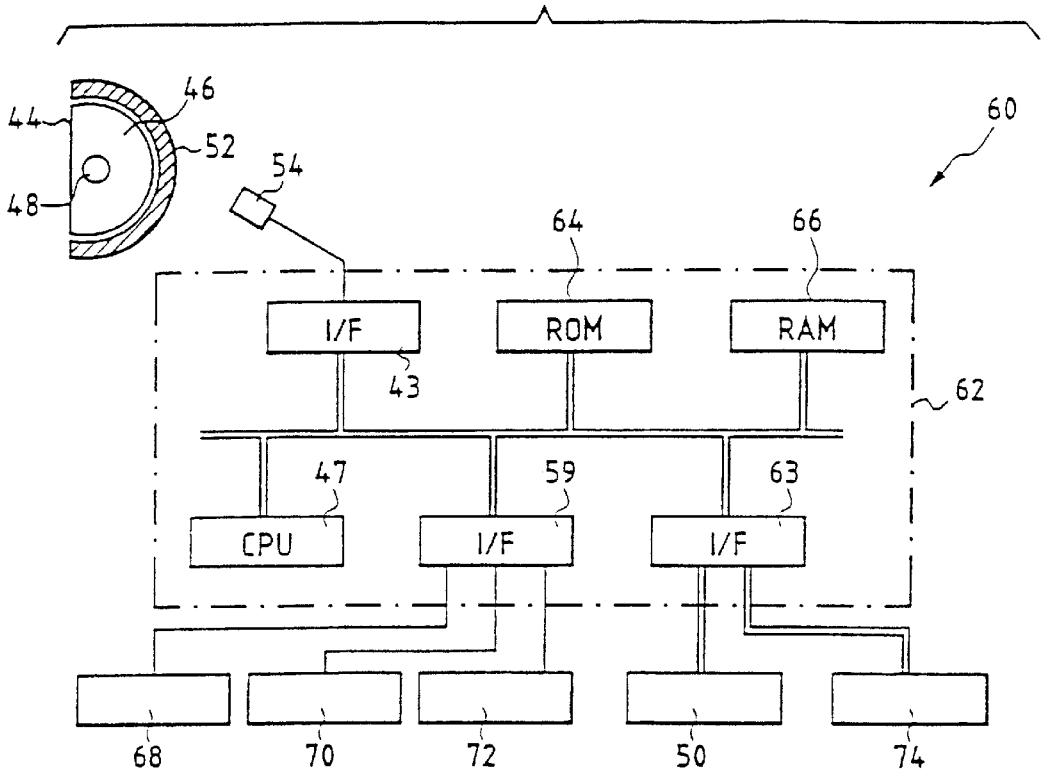
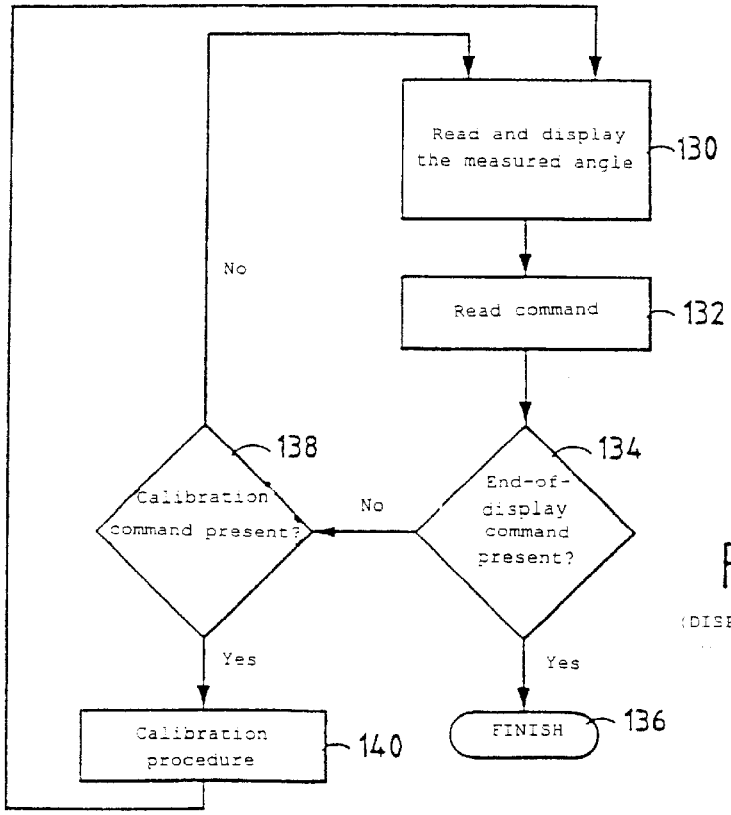
FIG.14
(DISPLAY PROCEDURE)

(AUTOMATIC CORRECTION PROCEDURE)

(QUALITY CONTROL PROCEDURE)

PRECISION PRESS BRAKE

CROSS REFERENCE TO RELATED APPLICATION

This is a division of U.S. patent application Ser. No. 09/600,166, filed Aug. 2, 2000, which is the National Stage of International Application No. PCT/FR00/01991, filed Jul. 10, 2000, the contents of which are expressly incorporated by reference herein in their entireties.

TECHNICAL FILED AND PRIOR ART

The invention relates to a press brake used in particular for bending metal sheets.

An example of a press brake, an known in the prior art, is shown schematically in Figures and 2.

It comprises an upper beam 1 placed above a lower beam 2. The latter is a fixed beam, bearing on its ends, while the upper beam 1 is a moving beam and is actuated in a vertical place by drive members located also at its two plates.

More specifically, the beam 1, 2 are mounted in a frame formed from two side plates 9*a* and 9*b* joined together especially by a bracing beam (not shown).

The upper beam 1 and the lower beam 2 are contained in the same vertical plane and the upper beam slides with respect to the side palates 9*a* and 9*b* with the aid of guiding means 8*a* and 8*b* consisting, for example, of two hydraulic rams.

Working edges of these two, upper and lower, beams bear a bending punch P and a corresponding die M, respectively.

As may be seen in FIG. 2, the lower part 4 of the lower beam 2 is fastened, by welding or by any other means, as its ends to the side plate 9*a* and 9*b* forming the frame of the press brake.

FIG. 3 shows a sheet 10 placed on the die M in which a "V", which will allow the bending, is formed. A force F is exerted along the axis of the "V", and at the extreme tip 12 of the punch P, in order to bend the sheet.

The bend angle of a metal plate or sheet depends on the extent of penetration of the punch P into the die M.

A press brake may, in general, carry out three types of bending.

The relative movement of the punch may be stopped at the stage shown in FIG. 4. This represents a first type of bending, called "3-point air bending".

This type of bending is obtained by limiting the stroke of the beam 1 during the set-up of the machine.

If, on the contrary, the penetration is increased, the sheet 10 descends into the "V" up to a limit defined by the bottom of the V (FIG. 5). This represents the technique called "semi-coining". This technique has furthermore the following characteristics:

- the radius Ri of the sheet, or plate, 10, internal to the bent zone, is in general equal to or slightly greater than the thickness of the sheet;
- when the pressure of the punch is released, reopening of the bend occurs, due to the residual elasticity of the sheet 10.

Finally, if the force is again increased, the tip 12 penetrates the sheet 10 and "swages" the bend radius (FIG. 5).

This represents so-called "coining" bending which has the following features:

- the inside radius Ri is less than the thickness of the sheet; it is determined by the radius of the punch;
- the bend angle is equal to that of the "V" of the die M and of the punch, the elasticity of the sheet having disappeared.

In the case of 3-point air bending, since the side walls of the bend, of the punch and of the die are never in contact with one another, the shape of the die is of little importance. It may, moreover, be a U.

Compared with bending to the bottom of the "V" and coining, air bending is that requiring the least force and the metal remains highly elastic.

These elements mean that this bending shape is the most sensitive to angular variations and requires particular attention in carrying it out.

In particular, in "3-point" bending, experience shows that a mechanical difference of 1/10 of a millimeter, measured for example between two 12-tip elements of two punches, results in an angular variation of 2° in bending a 2 mm sheet performed in a V of 12 (i.e. 6 times the thickness).

In general, and still in the case of "3-point" bending, using a width corresponding to 8 to 12 times the thickness of the sheet 10 to be bent allows partial bending to be carried out with a tolerance of ±10.

This is the optimum precision obtained with air bending.

A method making it possible to help in carrying out bending operations with optimum precision consists in using a protractor 16, mounted as illustrated in FIG. 6: the sheet 10 can bear on the arm 18 of the protractor, said arm being mounted on the die M.

When the edge of the sheet 10 is parallel to the arm of the protractor, the pressure on the punch is reduced to the minimum with the aid of the power control so as to allow the sheet to release the elastic bending stress. The angle A of this elasticity is determined with respect to the desired angle indicated by the protractor.

Next, the pressure is increased so as to increase the depth of bending of the elasticity angle, mentioned above (angle A).

The technique of "semi-coining" also results in springback of the sheet. Consequently, tooling with an 88° apex angle, for example, is chosen for 90° bending. This 88° angle may be reduced to 85° for thick sheets.

The bending precision, under optimum conditions, allows a tolerance of ±30 minutes or angle to be achieved.

The coining bending is that which allows the highest angular precision to be achieved, the elasticity of the sheet being eliminated. However, this type of bending requires it to be possible to increase, during the $2^{nd}$ phase of the bending force applied to the punch so as to bring the sheet edges back onto the side walls of the V of the die. The angle of the tooling is then the desired bend angle. The tools used must therefore be very accurate in order, in turn, to form the sheet to their specific characteristics.

The angular precision obtained with this type of bending may at best be 15 minutes of angle.

Consequently, it is apparent that the question of the precision of a press brake is a critical problem which, in most cases, is difficult to solve.

Moreover the bending precision is all the more difficult to obtain the thinner the sheet 10.

For heavy plate, unlike thin sheet, the imperfections become negligible compared with the unitary penetration for 1°.

There are also numerical control presses in which an operator enters a desired angle. The control then calculates the penetration and the force that are needed to obtain the desired angle. The calculation is performed with the aid of a known formula or with one developed by the user.

However, this formula can only be an approximation of reality and is not in general applicable to all cases or in the various types of bending, or does not have the same precision in all cases and in the various types of bending.

The problem arises as to how to make the bending machines more precise.

In particular, the problem arises of how to obtain a more precise calculation, or a more precise evaluation or indication, of the bending penetration.

Document JP-60-247 415 describes a press brake provided with a means for measuring distances between a lower tool and an upper tool and with a computing means for calculating an effective bend angle of a workpiece as a function of the distance measurements made. The effective bend angle is compared with the bend angle to be attained, and a correction to the descent of the tool is determined. A memory stores information relating to the relationship between the effective bend angle and the bend angle to be attained, and the bend angles and the level of descent of the tool.

The device described in that document involves a step of calculating the effective angle from measured distances and determines a correction to the descent of the tool according to these measured distances.

The precision obtained with this type of device is not satisfactory. This is because the calculation made during the calculation step is necessarily limited in its precision and its validity.

Furthermore, this method does not make a distinction according to the various types of bending carried out. An angle calculated for one measured distance and for one given type of bending is not necessarily valid, or does not necessarily have the same type of precision, for another type of bending.

SUMMARY OF THE INVENTION

The subject of the invention is firstly a numerical control system for a bending machine, comprising:

- means for inputting, as input data, a desired bend angle and bending conditions or criteria;
- means for storing one or more groups of data, each containing operating or bending conditions, a bend angle and at least one penetration depth;
- means for searching whether the input data is stored in the memory means, in the same group of data; and
- means for transmitting a signal representative of the penetration depth included in said same group of data, or for transmitting a signal for controlling the bending machine according to this penetration depth.

Thus, when the bending conditions and a desired angle, indicated by an operator, exist in the database, the device or the control system recovers the penetration value, stored in the memory means, which corresponds to these bending conditions and this desired angle.

It is therefore possible to carry out a bending operation according to the operating conditions employed, hence improved precision of the bending.

The value of the penetration depth then depends no longer only on a single variable, such as the distance between the lower and upper parts of the press.

The device is particularly advantageous in the case of three-point air bending or V-bottom air bending (semi-coining technique). In fact it is in these bending procedures that the problems of precision are most keenly felt.

According to one particular embodiment, the control device may furthermore include means for searching whether there exists, in the memory means, two groups of data having the same bending conditions as those input by the inputting means, and respective bend angles between which the desired angle lies, and for calculating a penetration depth according to the penetration depths belonging to the two groups of data, respectively.

The calculation of the penetration depth may consist, for example, of an interpolation between the penetration depths contained in the two groups or data.

If the desired conditions are not in the memory means and/or when the two aforementioned groups of bending data cannot be found, it is possible to calculate the penetration depth using a predetermined and preprogramed formula.

Advantageously, means may make it possible to modify, in the memory means, at least one parameter from among the bending conditions, the bend angles and the penetration depths.

Thus, the operator is not, limited to the values stored in the memory means.

Preferably, means are furthermore provided for comparing a measured bend angle with the desired bend angle, and means for correcting the penetration depth if the result of the comparison is that the measured angle is different from the desired angle.

Also preferably, means make it possible to update data in the memory means according to the result of the correction to the penetration depth. Other means may be provided for writing, into the memory means, an additional group of data containing the input data and the corrected penetration depth. The latter means are used when the input data are not already present in the same group of data stored in the memory means.

The device according to the invention thus has a changing, or dynamic, database which makes it possible to obtain greater precision as and when it is used.

It is thus possible to change the collected data according to the experience gained or to the operation of the machine. None of the machines known at the present time allow such a change. The precision of the machine improves as and when it is used: the more it is used, the more often it encounters various situations (which, statistically, cannot fail to occur) and the more numerous the situations that can be stored in the database.

The subject of the invention is also a press brake system comprising a control system as described above.

The invention also relates to a numerical control process for a bending machine comprising the following steps:

- storing, in memory means, one or more groups of data each containing bending conditions, a bend angle and at least one penetration depth;

receiving, as input data, a desired bend angle and bending conditions or criteria;

searching whether the input data is stored in the memory means, in the same group of data; and transmitting a signal representative of the penetration depth contained in said same group of data, or a signal for controlling the machine according to this penetration depth.

This process has the same advantages as those described above in relation to the numerical control system according to the invention.

BRIEF DESCRIPTION OF THE FIGURES

The features and advantages of the invention will become more apparent in the light of the description which follows. This description relates to the illustrative examples, given by way of nonlimiting explanation, with reference to the appended drawings in which:

FIG. 11 shows schematically a circuit for a digital protractor according to FIG. 10;

FIG. 14 shows a flow chart for a display procedure executed by the press brake system according to the invention;

DETAILED DESCRIPTION OF EMBODIMENTS OF THE INVENTION

Figure 1:
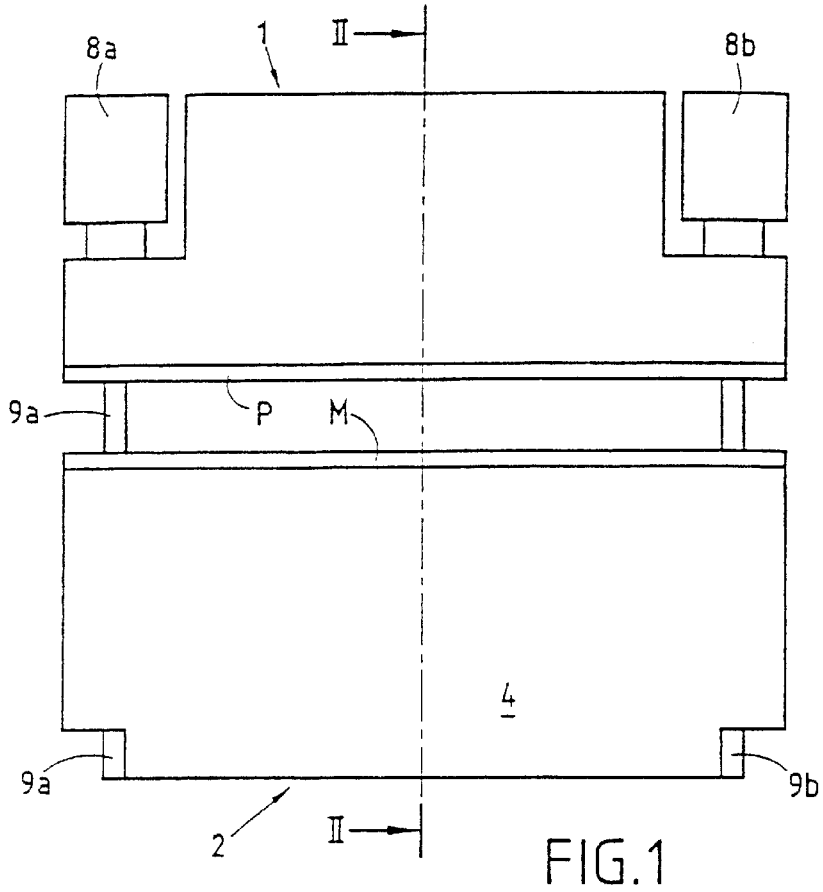
FIG. 1 shows a schematic view of a press brake according to the prior art, with movement members.
Figure 2:
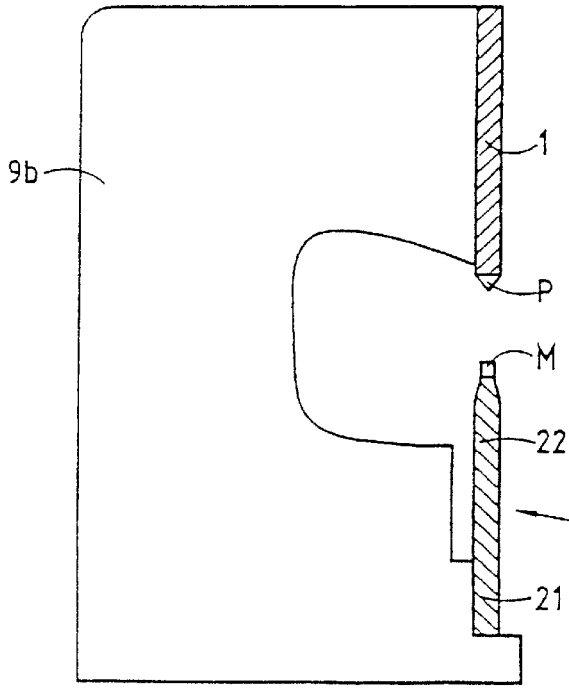
FIG. 2 shows a vertical sectional view on the line II—II in FIG. 1.
Figure 3:
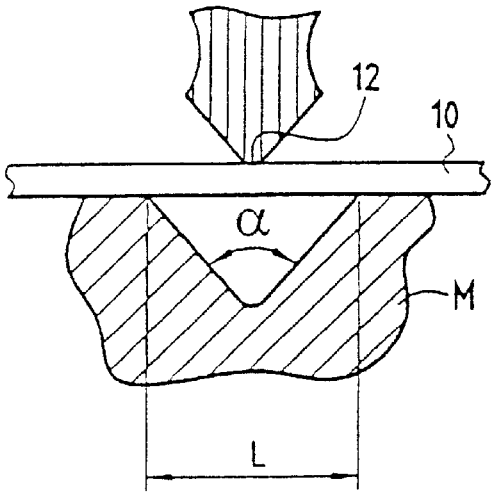
FIGS. 3 to 5 show various types of bending.
Figure 4:
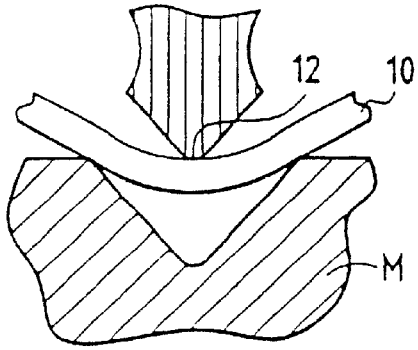
Figure 5:
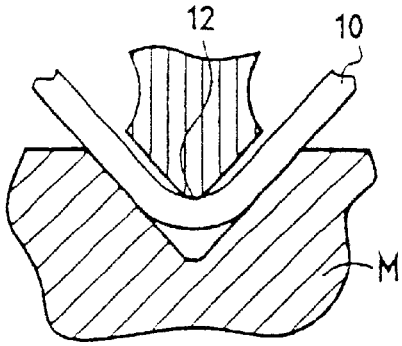
Figure 7A:
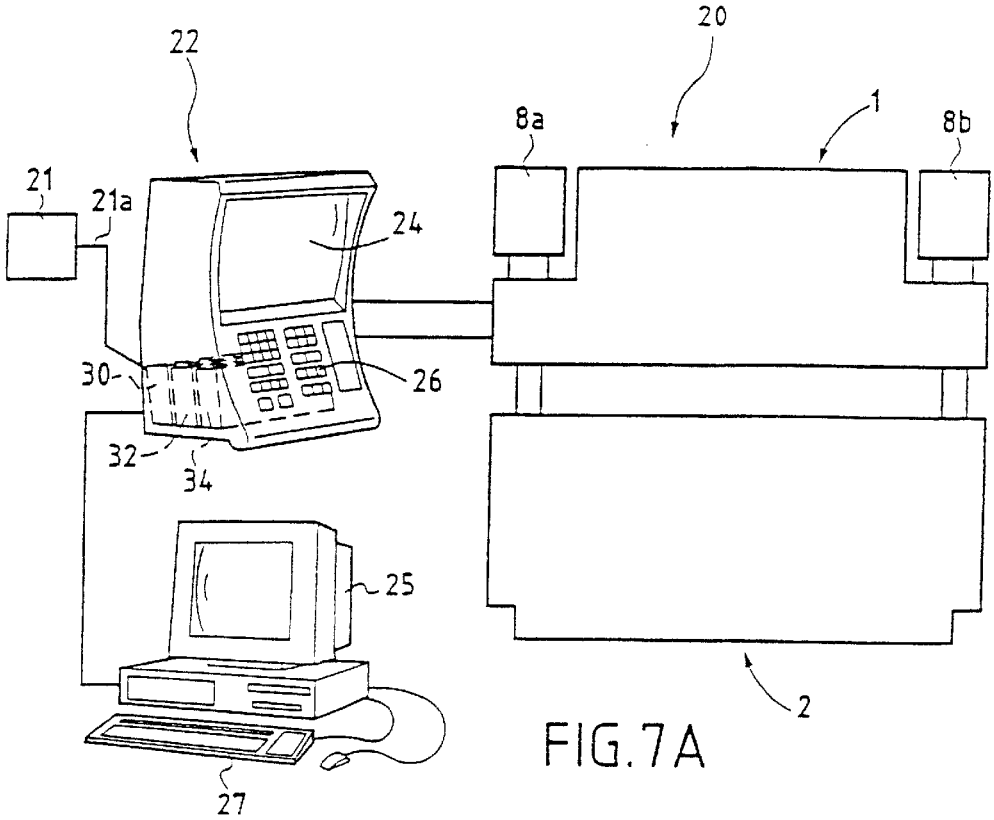
FIG. 7A shows schematically a press brake system according to the invention.

FIG. 7A shows schematically a press brake system 20 implementing a process according to the invention. This system comprises two beams, an upper beam 1 and a lower beam 2, of the type of those described above in relation to FIGS. 1 and 2, a numerical control system 22 which controls hydraulic rams 8*a*, 8*b* allowing the beam 1 to move with respect to the beam 2, and a digital protractor 21 used for measuring angles obtained after bending.

A terminal comprising a PC-type microcomputer, a display screen 25 and a keyboard 27 may furthermore be connected to the numerical control device 22 via a hard-wired link, for example of the RS232 type. This terminal allows the bending simulation programs to be executed.

The numerical control system 22 comprises a display screen 24 and a keyboard 26 allowing an operator to input data or information relating to an angle to be attained and/or bending or operating conditions as explained below in greater detail. It furthermore includes a processor 32 which in particular employs computing algorithms and algorithms for managing the numerical control which will be described later, an interface 30 serving for reading the numerical data transmitted by the digital protractor 21 via a cable 21*a*, and memory means or memory region 34.

The memory means 34 store the aforementioned computing and management algorithms. According to the present invention, the memory means 34 also contain a database. The database consists of groups of data, or of values, G1 to GN, where N is an integer, each group of data relating to three types of elements, namely:

a set of bending or operating conditions;

a bend angle; and one or more penetration depth values.

Figure 8A:
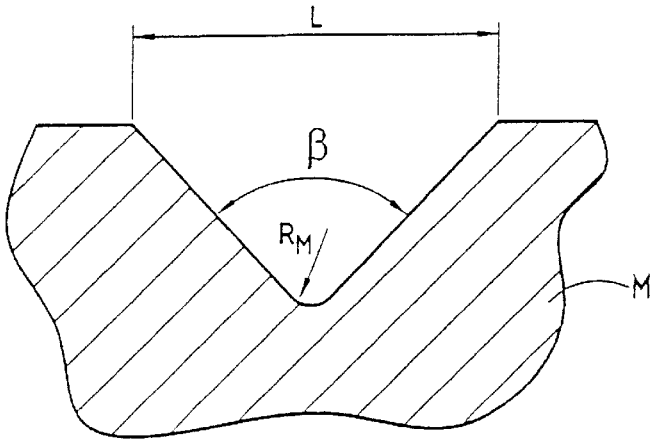
FIGS. 8A to 8C show a detail of a die, a punch and a bend, respectively.
Figure 8B:
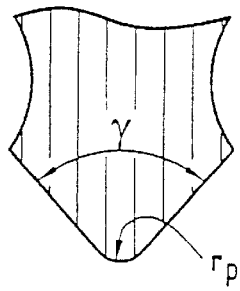
Figure 8C:
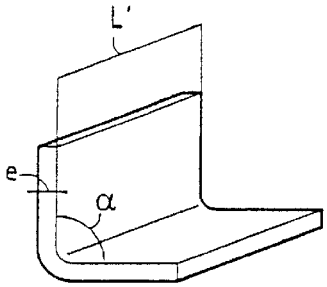
Figure 8D:
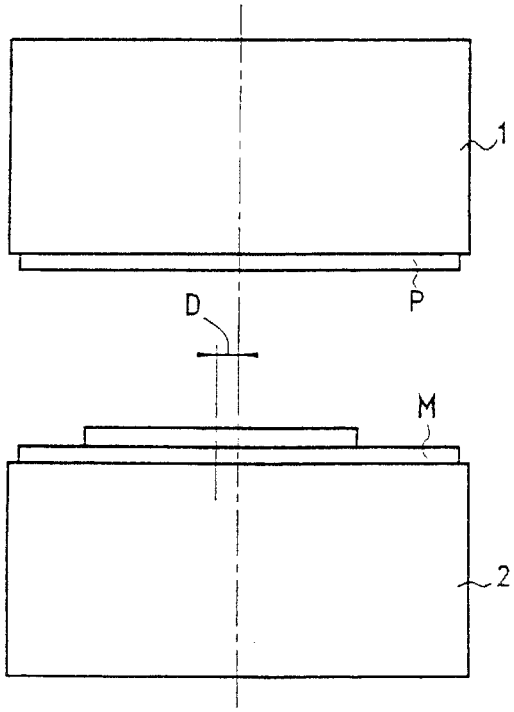
FIG. 8D shows an offset position of a workpiece to be bent, with respect to the center of a press brake.

The bending conditions or criteria may be the following:

criteria pertaining to the die (see FIG. 8A):
- angle $\beta$ of the die,
- the radius $R_M$ of the die,
- the width L of the die;

criteria pertaining to the punch (see FIG. 8B):
- angle $\gamma$ of the punch,
- radius $r_p$ of the end of the punch;

criteria pertaining to the workpiece (see FIG. 8C):
- thickness e of the workpiece,
- type of material,
- strength of the material;

criteria pertaining to the bend (see FIGS. 8C and 8D):
- width L' of the bending,
- offset D of the workpiece with respect to the center of the machine.

By way of illustration, Table I shows three groups of data G1, G2 and G3 stored in the database.

TABLE I

| | contents of the database | | | | | |
|---|---|---|---|---|---|---|
| | G1 | G2 | G3 | G4 | G5 | G6 |
| Die angle | 90 | 90 | 90 | | | |
| Die radius | 0.20 | 0.20 | 0.20 | | | |
| Die width | 10 | 10 | 10 | | | |
| Punch angle | 90 | 90 | 90 | | | |
| Punch radius | 0.2 | 0.2 | 0.2 | | | |
| Workpiece thickness | 1 | 1 | 1 | | | |
| Type of material | Steel | Steel | Steel | | | |
| Strength of the | 40 | 40 | 40 | | | |

TABLE I-continued

| | contents of the database | | | | | |
|---|---|---|---|---|---|---|
| | G1 | G2 | G3 | G4 | G5 | G6 |
| material | | | | | | |
| Bending length | 1000 | 1000 | 1000 | | | |
| Workpiece offset | 0 | 0 | 0 | | | |
| Bend angle | 90 | 120 | 135 | | | |
| Initial penetration Y1 | −2.26 | −1.55 | −1.11 | | | |
| Initial penetration Y2 | −2.26 | −1.55 | −1.11 | | | |
| Correction CO1 | −0.05 | −0.12 | 0.08 | | | |
| Correction CO2 | −0.05 | −0.12 | 0.08 | | | |

Each group of data G1 to GN contains data representative of the bending conditions, a value of a bend angle and penetration depth values, also called updated or corrected penetration depth values. The penetration depth values are divided into initial penetration values Y1 and Y2 and corresponding correction values CO1 and CO2. Each penetration depth (updated depth) is equal to the sum of the initial penetration value Y1, Y2 and of the corresponding correction CO1, CO2. Each penetration depth Y1+CO1, Y2+CO2 is associated with a hydraulic axis of the press brake. More specifically, the Y1+CO1 and Y2+CO2 values are representative of the movement of the punch into the Vee of the die that the rams 8*a*, 8*b* shown in FIG. 7*a* must undergo respectively in order to obtain the bend angle. Some machines, especially those of the "bottom working" type, in which the lower beam 2 is the moving beam and the upper beam 1 is the fixed beam, use only one axis per bend and therefore require only one indication Y of the penetration value and only one indication of the correction value.

The groups of data G1 to GN may be stored beforehand in the database before any operation by the manufacturer or a user. Thereafter, the database may be modified or supplemented by the user, via the keyboard 26 and the screen 24. It may also be modified or supplemented by the numerical control system 22 during execution of a correction procedure, which will be described in detail below.

The initial penetration values Y1, Y2 are generally values which have been obtained beforehand by calculation or by interpolation, for example from bending conditions and from a desired bend angle which are supplied to the numerical control system 22 by the operator, during execution of a programing procedure which will also be described below in detail. The correction values CO1, CO2, when they are nonzero, are values which have been obtained beforehand during execution of the aforementioned correction procedure.

Figure 7B:
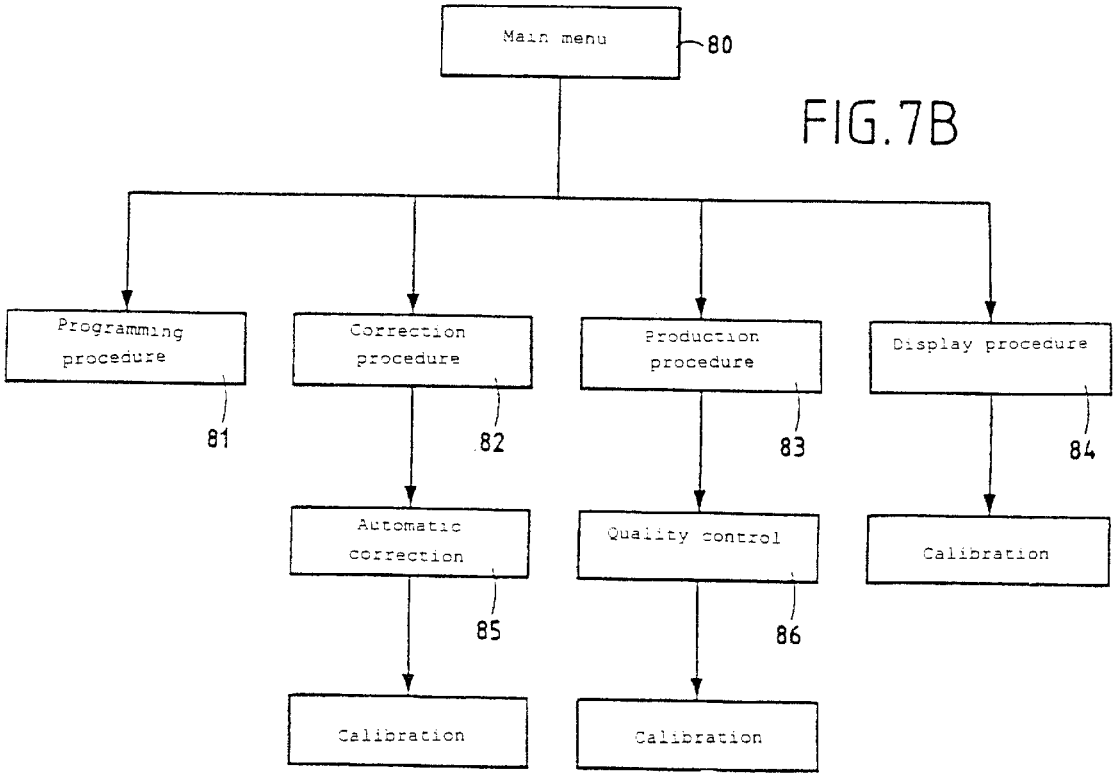
FIG. 7B shows procedures of operating the press brake system according to the invention.

FIG. 7B illustrates schematically the various operating procedures of the press brake system according to the invention.

The operator can select, from a main menu 80 appearing on the display screen 24 of the numerical control system 22, a programing procedure 81, a correction procedure 82, a production procedure 83 or a display procedure 84.

In the programing procedure 81, the operator can program a workpiece to be bent. To do this, he enters bending conditions and a desired bend angle into the numerical control system 22 via the keyboard 26. The bending conditions entered by the operator must be of the same type as those stored in the database (criteria pertaining to the die, the punch, the workpiece and the bend). The system 22 then determines, for each hydraulic axis, a penetration value Y1, Y2 allowing the desired bend angle to be obtained.

Figure 9:
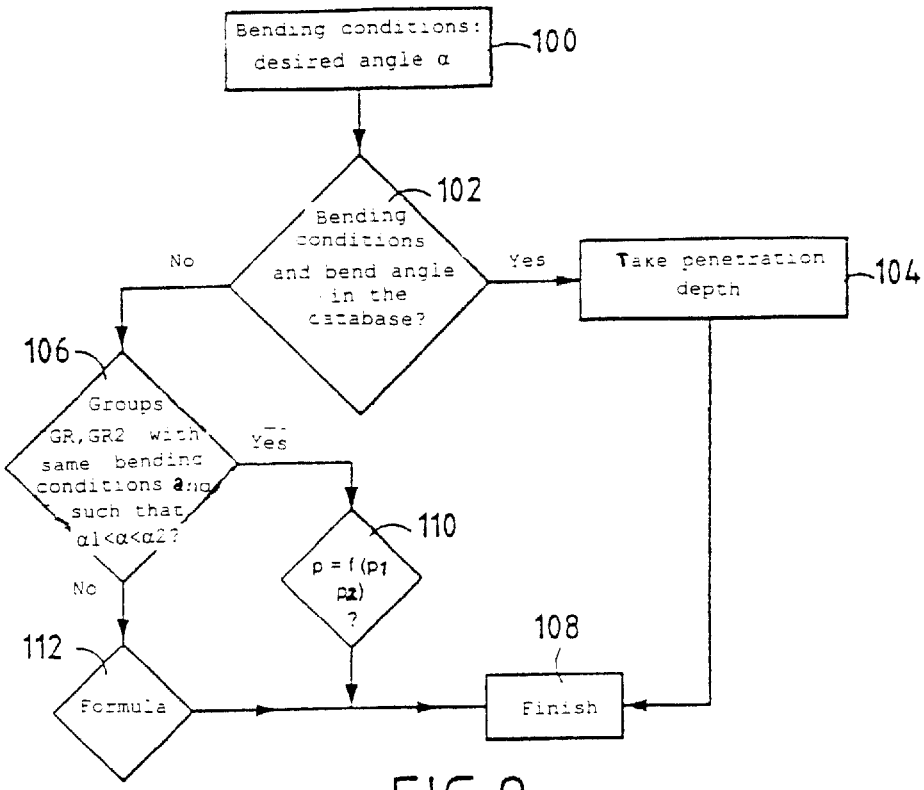
FIG. 9 shows a flow chart for a programing procedure executed by the press brake system according to the invention.

FIG. 9 shows the algorithm employed by the numerical control system 22, and more particularly by its processor 32, during execution of the programing procedure.

At a step 100, the numerical control system 22 reads the bending conditions and the value α of the desired bend angle which are entered by the operator via the keyboard 26.

During a step 102, the numerical control system 22 interrogates the database, contained in the memory means 34, in order to verify whether there exists, in this database, a group of data having the same bending conditions and the same bend angle as those entered by the operator.

If such a group exists, the penetration depth included in the group, equal to the sum of the initial penetration depth value and of the corresponding correction, for each axis, is selected as the penetration depth to be employed and is displayed on the display screen 24 (step 104). The operator can then request the numerical control system 22, via the keyboard 26, to send a command or a signal to the press brake 1–2–8*a*–8*b* so as to make it execute the bending with this penetration depth. The bending is executed under the action of the hydraulic rams 8*a*, 8*b* which move the upper beam 1 through a distance allowing this penetration depth to be attained.

If a group of data having the same bending conditions and the same bend angle as those input by the operator does not exist in the database, a search is made (step 106) to see whether two groups of values GR1 and GR2, each having bending conditions identical to those input by the operator and having respective bend angles α1 and α2, such that α1<α<α2, exist. If these groups exist, an estimate is made (step 110), for each axis, of a penetration depth p to be used based on depths p1 and p2, corresponding to this axis, which are stored in the groups GR1 and GR2, respectively. This is, for example, a calculation of p by interpolation between p1 and p2, for example: p=(p2−p1).(α−α1)/(α2−α1). The sum of the initial penetration depth value and of the corresponding correction, which are contained in the database, is taken as depth value p1, p2.

If groups GR1 and GR2 having the same bending conditions as those indicated by the operator and for which α1<α<α2 are not found, then a depth p is calculated (step 112) from a preestablished formula, for example the following formula (1):

$$Y_{P\alpha}+Y_{RE}=e+r+[V/2+r\tan(45-\beta/4)]\tan(90-\alpha/2)-[(r_i+e+r)/\cos(90-\alpha/2)]+(r_i/V)[V+2r\tan(45-\beta/4)-2r\sin(90-\alpha/2)]+K\sin 2(\alpha-90)+VP_u/8e \quad (1)$$

where:

$Y_{P\alpha}$ represents the penetration in order to obtain the angle α;

$Y_{RE}$ represents the springback;

e represents the thickness of the sheet or of the workpiece near the bend;

r represents the radius of the Vee;

V represents the width of the Vee;

β represents the angle of the die;

$\alpha$ represents the requested angle;

$r_i$ represents the inside radius of the bend;

K represents the coefficient of the Hook curve;

$P_u$ represents the unitary penetration.

According to another embodiment of the algorithm illustrated in FIG. 9, step 110, used when two groups GR1 and GR2 as described above have been found in the database, is carried out not by means of a simple interpolation on the penetration depth values but in the following manner:

a preestablished formula, such as for example formula (1) above with, as parameters, especially the bending conditions and the bend angle which are input into the numerical control system 22 by the operator, is applied in order to obtain a first penetration value; and a corrective term equal to $(Corr2-Corr1).(\alpha-\alpha1)/(\alpha2/\alpha1)$ is added to this first penetration value, where Corr2 is the correction part for the depth p2 (equal to the difference between the penetration depth p2 and the corresponding initial penetration depth) and Corr1 is the correction part for the depth p1.

According to yet another embodiment of the present invention, step 110 is used by carrying out an interpolation not on the bend angle but on one of the bending conditions, such as the thickness of the workpiece to be bent.

Thus, instead of searching for two groups of data having the same bending conditions as those indicated by the operator and respective angles $\alpha1$ and $\alpha2$ such that $\alpha1<\alpha<\alpha2$, the numerical control system 22 will search, in its database, for two groups of data GR1' and GR2' having the same bending conditions as those indicated by the operator, except with regard to the thickness of the workpiece, having the same bend angle as that programed by the operator, and such that the respective sheet thicknesses e1, e2 satisfy the following condition: $e1<e<e2$, where e is the thickness of the sheet programed by the operator.

An interpolation, for example of the $p'=(p2'-p1').(e-e1)/(e1-e2)$ type, where p1' and p2' are the penetration depths (updated values) of the groups of data GR1' and GR2' respectively, can then be carried out in order to obtain an estimate of the penetration depth.

As a variant, it is also possible to apply a preestablished formula such as formula (1) above with, as parameters, especially the bending conditions and the bend angle that are indicated by the operator, in order to obtain a first penetration value, and to add a corrective term to this first penetration value, said corrective term being equal to $(Corr2'-Corr1').(e-e1)/(e2-e1)$, where Corr1' is the correction part for the penetration depth p1' and Corr2' is the correction part for the penetration depth p2'.

According to yet another embodiment of the present invention, step 106 may consist in performing a first search, in the database, in order to determine whether two groups of data GR1 and GR2 of the type of those described above (with $\alpha1<\alpha<\alpha2$) are present and, if such groups are not found, in performing a second search in order to determine whether two groups of data GR1' and GR2' (with $e1<e<e2$) are present. Thus, if the numerical control system 22 does not find groups GR1, GR2, but does find two groups GR1' and GR2', it performs an interpolation on the thickness of the workpiece.

The penetration depth value p calculated in step 110 or 112 is displayed on the display screen 24 and the operator can, as described above in the case of step 104, execute the bending on the basis of this value.

The correction procedure, denoted by the label 82 in FIG. 7B, makes it possible to correct the penetration depth determined by the numerical control system 22 during execution of the programing procedure, when the operator, after having requested the execution of a bend on the basis of this penetration depth, is not satisfied with the angle actually obtained.

Figure 6:
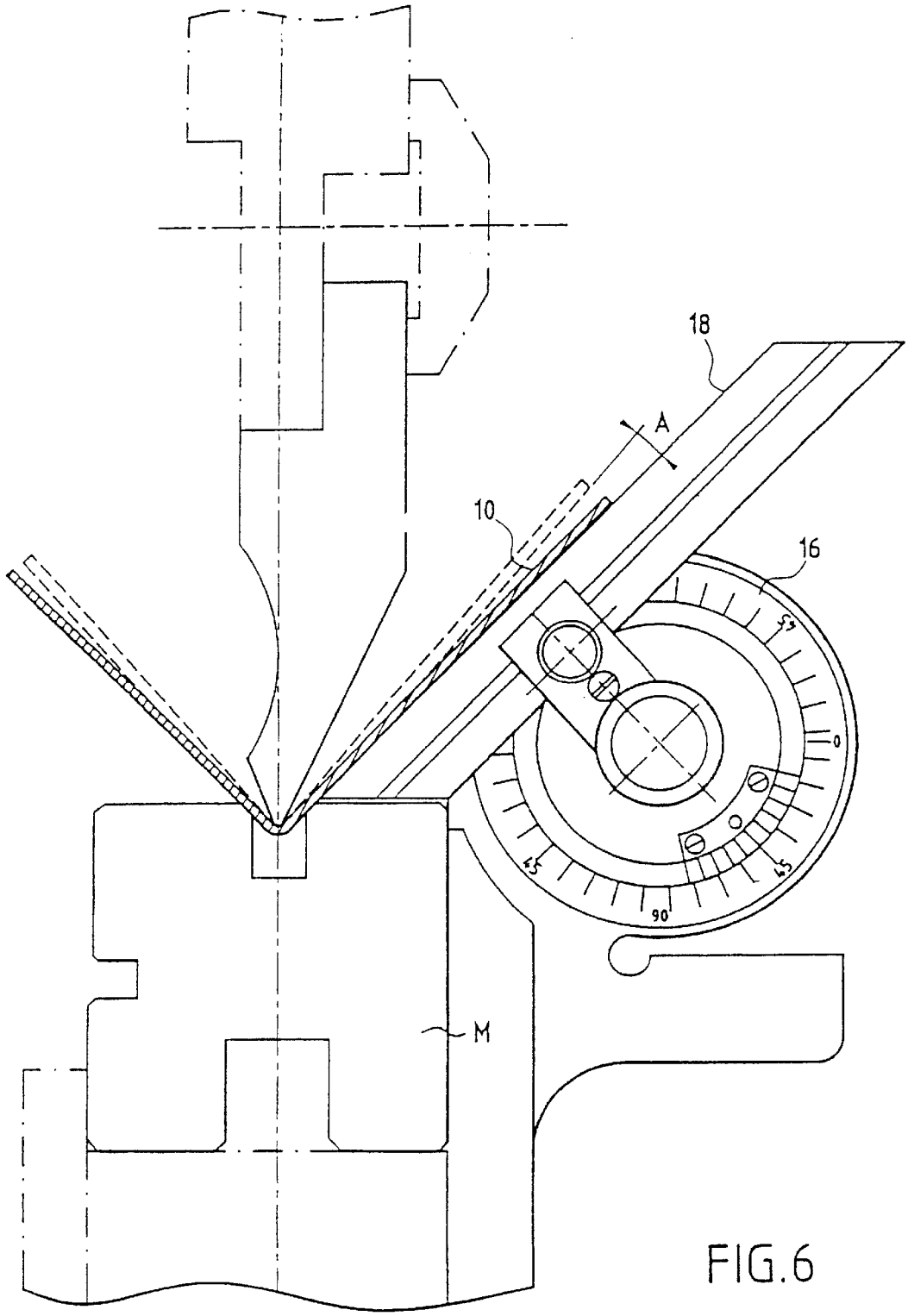
FIG. 6 shows a press equipped with a protractor.

In practice, after having programed a workpiece in the programing procedure the operator can, as already explained, request the numerical control system 22 to control the bending machine 1–2–8*a*–8*b* according to the penetration depth value determined by the numerical control system 22. The operator can then measure the angle of the bend thus produced, in order to check whether this angle corresponds well to the angle $\alpha$ that he had programed Such a measurement may be made using a conventional tool or a conventional protractor of the type described above in relation to FIG. 6. In this case, after the operator has activated the correction procedure, he enters, via the keyboard 26, the measured angle into the numerical control system 22, which compares the programed angle with the measured angle. If these two angles are different, the numerical control system 22 determines a correction value for the penetration depth depending on the difference in angle, in a manner known by those skilled in the art, using a preestablished formula, such as formula (1) described above. More specifically, the formula is applied to the programed angle, in order to obtain a first penetration depth; the same formula is then applied to the measured angle, in order to obtain a second penetration depth. The correction value then corresponds to the difference between the first and second penetration depths. Next, the operator can execute a bend on the basis of the corrected penetration depth, equal to the sum of the initial penetration depth and the calculated correction value.

The system 22 furthermore modifies the database so as to take into account the correction applied. If the bending conditions and the bend angle input by the operator into the numerical control system 22 during execution of the programing procedure were already stored in the database, in the same group of data, with an initial penetration depth value and a corresponding correction value (which is equal to zero if no correction had already been made to the penetration depth value corresponding to said bending conditions and said bend angle), the numerical control system 22 modifies the correction value in the database.

If on the other hand the set of data consisting of the bending conditions and the bend angle input by the operator is not stored in the database, that is to say if the penetration depth as defined during execution of the programing procedure has been calculated by means of an interpolation or of a preestablished formula as explained above, the numerical control system 22 inputs an additional group of data into the database, comprising the bending conditions, the bend angle, the initial penetration depth value (as determined by interpolation or the preestablished formula during execution of the programing procedure) and the correction value.

According to another embodiment, the digital protractor 21 is used instead of the aforementioned conventional protractor for measuring the angle obtained.

Figure 10:
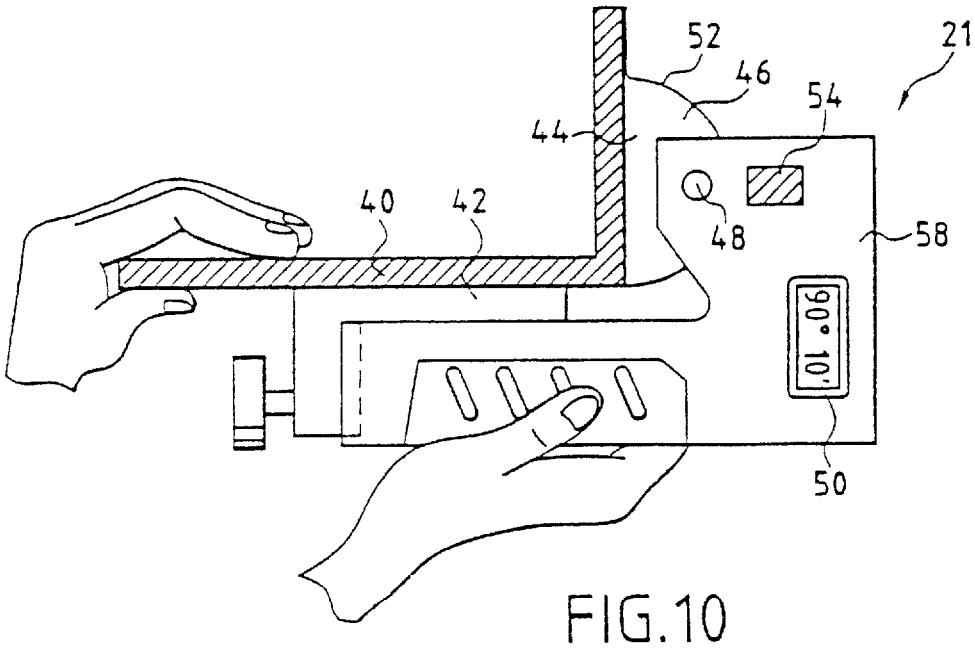
FIG. 10 shows schematically a digital protractor in the press brake system according to the invention.

FIG. 10 shows in detail the digital protractor 21. This protractor is used to measure the angle of a workpiece in the following manner. A workpiece 40 is held against a first support element 42, for example in the form of an L, and against a flat face 44 of an element 46 which can pivot about an axis of rotation 48. An angle indicator 50 displays the angles of rotation of the pivoting component 46. A graduated scale 52 is marked along the circumference of the pivoting element 46. A detector 54 allows the value of the scale 46 at a certain fixed point with respect to the casing 58 of the component to be read.

The detector 54 sends the measurement signals to an interface 60 comprising (FIG. 11) a central control unit 62 which includes a ROM memory 64, a RAM memory 66 and switching means 68 (for identifying an origin), switching means 70 (for recording) and switching means 72 (general switching). The label 50 represents, as in FIG. 10, a screen for displaying the data. Means 74 furthermore allow signals corresponding to the measurements taken to be transmitted to the interface 30 of the numerical control system 22.

The digital protractor may be calibrated beforehand by the operator. For this purpose, the operator activates a calibration procedure. A calibration page appears on the screen 24 of the numerical control 22. In practice, the calibration procedure is activated automatically by the numerical control system 22 when, at the start of an automatic correction procedure, of a quality control procedure or of a display procedure, which procedures will be described below, the system 22 realizes that the calibration has not been carried out.

During the calibration, the pivoting element 46 is brought, for example manually, into a chosen position as reference position for an angle of 180°. The operator validates the choice of this position by acting on the switching means 68. The display screen 50 or the console 24 then displays an angle value of 180°. By acting a second time on the switching means 68, the operator terminates the calibration phase.

When the operator activates, in the correction procedure 82, a function or a procedure, called the automatic correction procedure, denoted by the label 85 in FIG. 7B, the value of the angle measured by the digital protractor 21 is read by the numerical control system 22, which then compares the programed angle with the measured angle and determines a correction value for the penetration depth according to the difference in angle. The correction value is determined in the same way as described above in relation to the correction procedure, that is to say by applying a preestablished formula to the programed angle, by applying this same formula to the measured angle and by calculating the difference between the two penetration depths thus obtained.

The system 22 furthermore modifies the database so as to take into account the correction made. If the bending conditions and the bend angle input by the operator into the numerical control system 22 during execution of the programing procedure were already stored in the database, in the same group of data, with an initial penetration depth value and a corresponding correction value (which is equal to zero if no correction had already been made to the penetration depth value corresponding to said bending conditions and said bend angle), the numerical control system 22 modifies the correction value in the database.

If on the other hand the set of data consisting of the bending conditions and the bend angle input by the operator is not stored in the database, that is to say if the penetration depth as determined during execution of the programing procedure was calculated by means of an interpolation or of a preestablished formula as explained above, the numerical control system 22 inputs, into the database, an additional group of data comprising the bending conditions, the bend angle, the initial penetration depth value (as determined by interpolation or the preestablished formula during execution of the programing procedure) and the correction value.

The database according to the invention is therefore dynamic, that is to say it can be supplemented as and when the press brake system is used.

Figure 12:
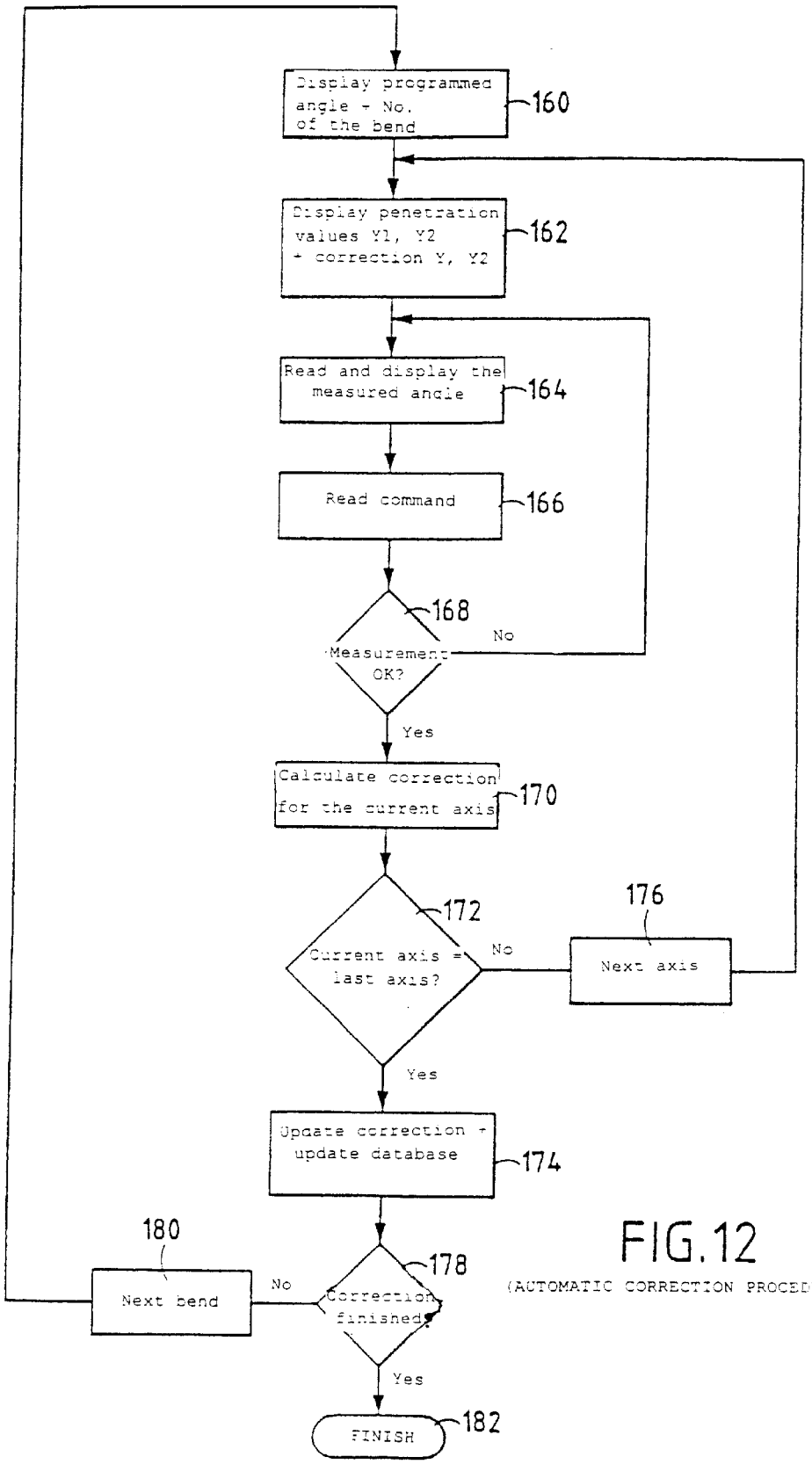
FIG. 12 shows a flow chart for an automatic correction procedure executed by the press brake system according to the invention.

FIG. 12 illustrates in detail the algorithm employed by the numerical control system 22 during execution of the automatic correction procedure.

In a first step 160, the programed angle is displayed. Displayed next (step 162) are one or two penetration values Y1, Y2 and one or two penetration correction values (cf. FIG. 15), depending on the number of hydraulic axes provided on the bending machine 1–2–8*a*–8*b*. The correction values are zero if no correction was made beforehand to the penetration depths.

The actual angle obtained after bending, and measured by the operator using the digital protractor described above, is displayed (step 164) by the numerical control system 22.

The device then reads a validation command (step 166) given by the operator, for example by pressing the switch button 68 of the digital protractor for a longer or shorter time.

If the operator indicates, in reply, that the measurement taken by the digital protractor is not correct (step 168), the measurement step is repeated (return to 164).

If the operator indicates in reply that the measurement is correct, the latter is taken into account by the numerical control system 22 in order to assign a correction value to the initial penetration depth, in the manner explained above, for the axis in question (step 170).

If the axis involved is the last axis (step 172), the database is updated (step 174) in the manner explained above.

Otherwise, the procedure is repeated for the next axis (step 176).

Finally, the correction procedure may be continued for another bend (steps 178, 180), which is also characterized by one or two axes, or else the operator decides to terminate the automatic correction procedure (step 182).

Figure 15:
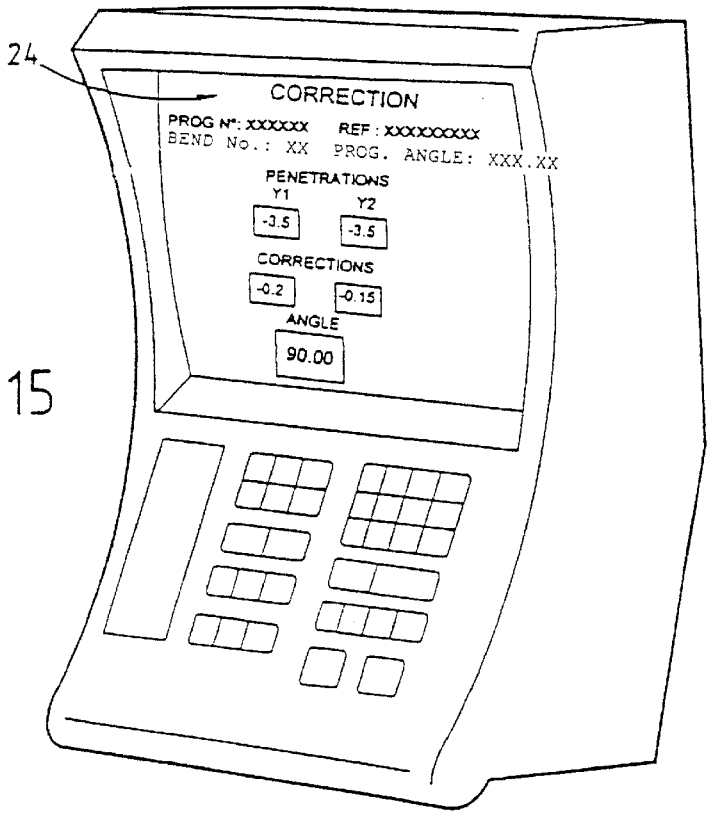
FIG. 15 shows a display obtained during execution of the automatic correction procedure.

An example of information presented to the operator during execution of this automatic correction procedure is illustrated in FIG. 15. This screen displays the two penetration values Y1, Y2, the two correction values and the measured angle value (here: 90°).

The production procedure, denoted by the label 83 in FIG. 7B, is activated by the operator when, after having programed a workpiece (programing procedure) and optionally corrected the penetration depth (correction procedure), he desires to mass-produce the part. The numerical control system 22 sends a control signal to the press brake 1–2–8*a*–8*b* in order to start the production on the basis of the penetration depth determined during the programing procedure or, if the correction procedure was also activated, on the basis of the corrected penetration depth.

Figure 13:
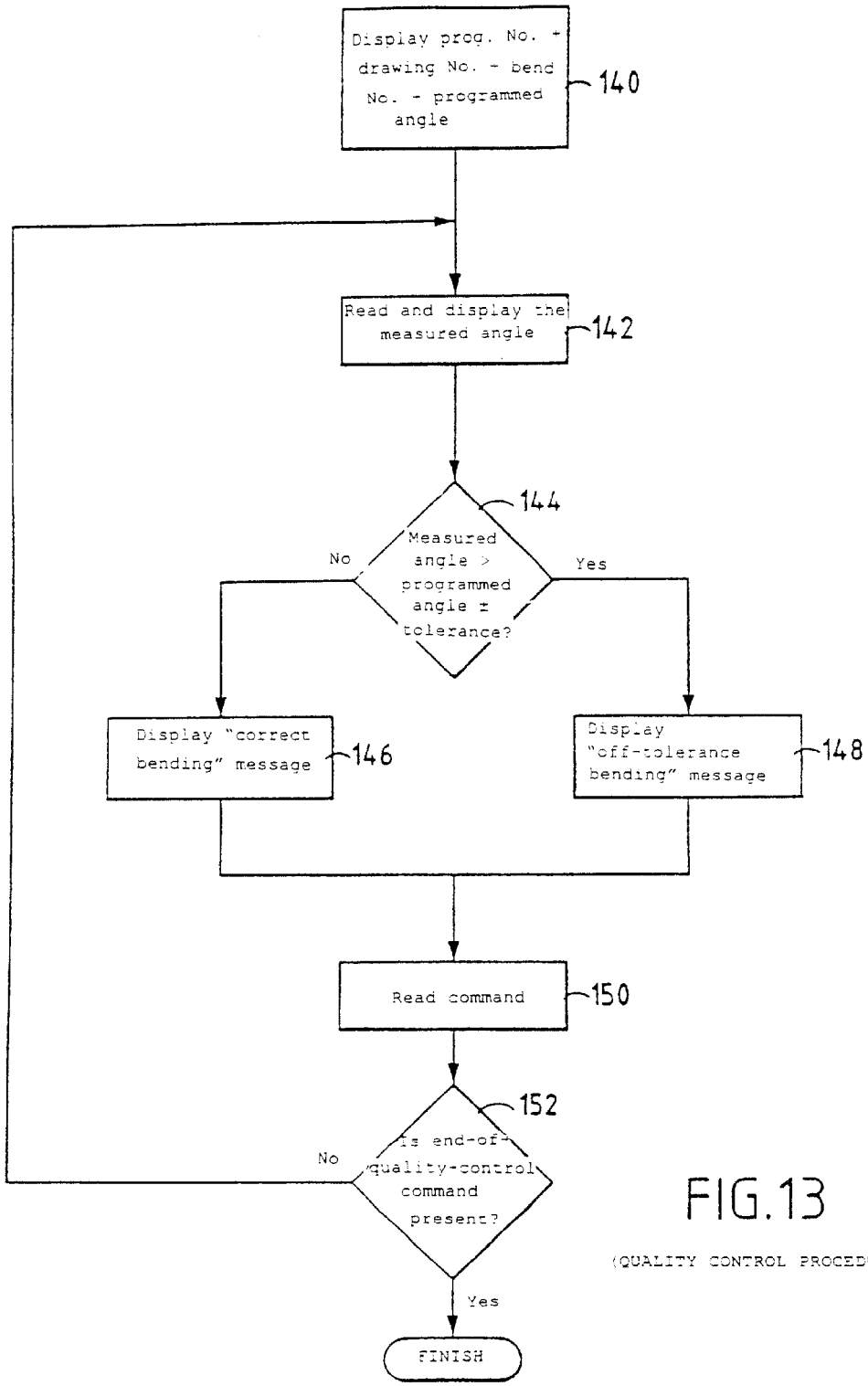
FIG. 13 shows a flow chart for a quality control procedure executed by the press brake system according to the invention.

During the production cycle, the operator can furthermore activate a so-called quality control procedure, denoted by the label 86 in FIG. 7B. This procedure allows the angle of the last bend produced to be verified. The algorithm used by the numerical control system 22 during execution of the quality control procedure is illustrated in FIG. 13.

At a first step 140, the programed angle is displayed.

Figure 16:
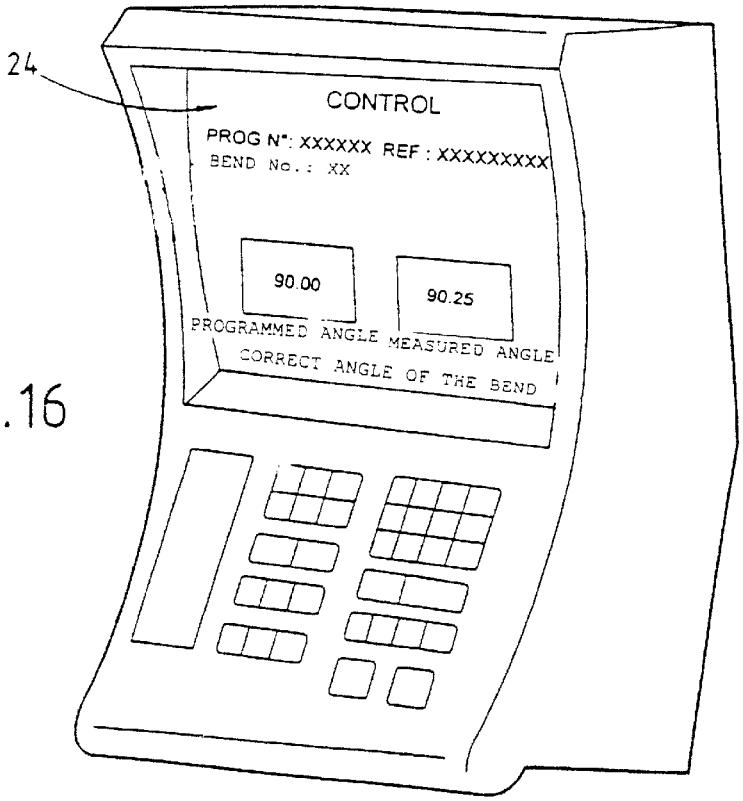
FIG. 16 shows a display obtained during execution of the quality control procedure.

There follows the reading and displaying (step 142) of an angle measured by the operator using the digital protractor 21. This measured angle is displayed. An operator can thus display both the programed angle and the measured angle, as illustrated in FIG. 16.

The numerical control system 22 compares the measured angle with the programed angle and it is checked (step 144) if the measured angle lies within the tolerance range with respect to the programed angle.

Depending on the result of the comparison, a correct bending message or an off-tolerance message is displayed (steps 146, 148).

The apparatus then reads an end-of-quality-control command (step 150) given by the operator, for example by pressing the switch button 68 of the digital protractor 21 for a longer or shorter time.

If the end-of-quality-control command is present (step 152), the machine quits the quality control procedure. Otherwise, the reading is repeated (step 142).

The operator, using this quality control procedure, can perform random checks on any angle during the production or bending cycle.

The display procedure, denoted by the label 84 in FIG. 7B, is used to display, on the screen 24, an angle measured by means of the digital protractor 21 and transmitted by the latter to the numerical control system 22 via the cable 21*a*.

Figure 17:
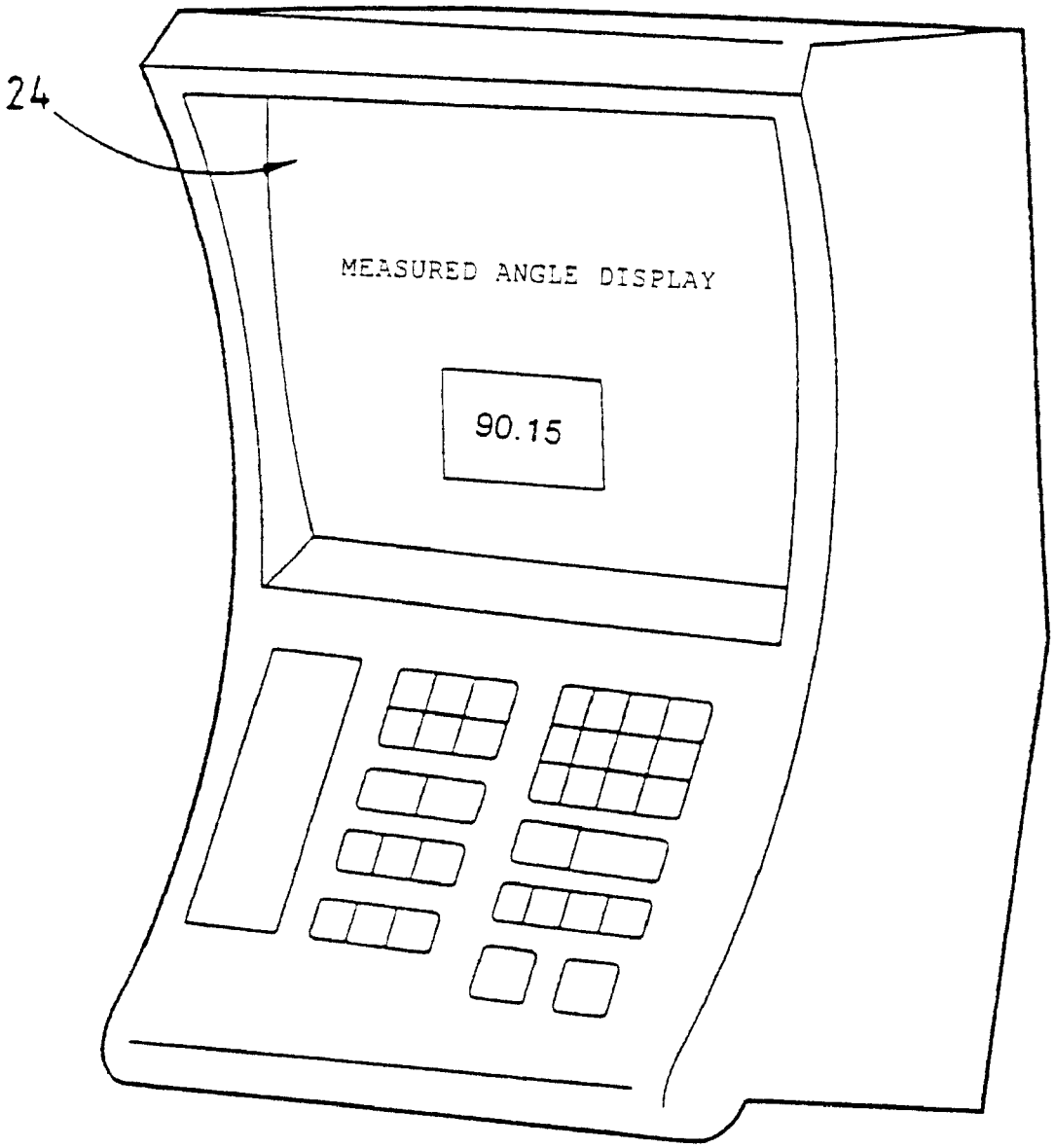
FIG. 17 shows a display obtained during execution of the display procedure.

The algorithm used by the numerical control system 22 during execution of the display procedure is illustrated in FIG. 14. At a step 130, an angle of a workpiece positioned on the digital protractor 21 is measured and displayed on the screen 24 (cf. FIG. 17) until an end-of-display command (step 134) or a calibration command (step 138) is present. The end-of-display command is given by the operator, for example by pressing the switch button 62 of the digital protractor 21 for a prolonged time, whereas the calibration command is given by pressing this same button in the manner of a pulse. If the numerical control 22 detects an end-of-display command, the execution of the display procedure terminates at a step 136. If the numerical control detects a calibration command, the calibration procedure, described above, is activated at a step 140.

The process according to the invention, described above especially in connection with FIGS. 7B, 9, 12, 13 and 14, is preferably carried out by means of a program executed by the processor 32 of the numerical control system 22 and stored in the memory region 34. This program may have been loaded from a support medium (for example a diskette or CD Rom or any magnetic support medium) capable of being read by a computing system or by the numerical control system 22.

Such a support medium therefore contains instructions for carrying out a process according to the invention, as described above, and especially in relation to one of FIGS. 7B, 9, 12, 13 and 14.

The whole system may also be linked to other peripheral devices, for example to an electronic communication network, making it possible to send and/or receive data relating to the bend angles or bending conditions.

Thus, a number of machines from the same manufacturer may be linked by a network to a central control unit which collects the data stored by all of the machines individually. This results in the construction of much larger files, thus making it possible, for example, to perform statistical analyses.

I claim:

1. A numerical control device for a bending machine comprising:

a keyboard;

a memory that stores one or more groups of data, each containing bending conditions, a bend angle and at least one penetration depth, that stores program instructions for searching whether data, comprising bending conditions and a desired angle input with said keyboards is stored in the memory device, in a same group of data, and that sends a signal to the bending machine so that the bending machine executes a bending according to the penetration depth included in said group of data, and a processor that executes said program instructions.

2. A numerical control device for a bending machine comprising:

a keyboard;

a memory that stores one or more groups of data, each containing bending conditions, a bend angle and at least one penetration depth, that stores program instructions for searching whether data input with said keyboard is stored in the memory device, in a same group of data, and that sends a signal to the bending machine so that the bending machine executes a bending according to the penetration depth included in said group of data, said memory further storing instructions for searching, when said input data is not stored in the memory, in a same group of data, whether there exists, in the memory, two groups of data having the same bending conditions as those input by the keyboard, and respective bend angles between which the desired bend angle lies, and for calculating a penetration depth according to the penetration depths belonging to the two groups of data, respectively, and a processor that executes said program instructions.

3. A numerical control device for a bending machine comprising:

a keyboard;

a memory that stores one or more groups of data, each containing bending conditions, a bend angle and at least one penetration depth, that stores program instructions for searching whether data input with said keyboard is stored in the memory device, in a same group of data, and that sends a signal to the bending machine so that the bending machine executes a bending according to the penetration depth included in said group of data, said memory further storing instructions for calculating a penetration depth using a predetermined formula, when the input data is not contained in a same group of data stored in the memory device and when two groups of data having the same bending conditions as those input by the keyboard and respective bend angles between which the desired angle lies do not exist in the memory, and a processor that executes said program instructions.

4. The numerical control device according to any of claim 1, 2 or 3, said memory further stores instructions for modifying at least one of a bending condition, a bend angle, and a penetration depth.

5. The numerical control device according to any of claim 1, 2 or 3, wherein the bending conditions are chosen from among the following:

conditions pertaining to a die used, conditions pertaining to a punch used, conditions pertaining to a workpiece to be worked, and conditions pertaining to a bend to be produced.

6. The numerical control device according to claim 5, wherein the conditions pertaining to the die used comprise at least one of the angle of the die, the radius of the die and the width of the die.

7. The numerical control device according to claim 5, wherein the conditions pertaining to the punch used comprise at least one of the angle of the punch and the radius of the punch.

8. The numerical control device according to claim 5, wherein the conditions pertaining to the workpiece comprise at least one of the thickness of the workpiece, the type of material of which the workpiece is composed, and the strength of the workpiece material.

9. The numerical control device according to claim 5, wherein the conditions pertaining to the bend relate to at least one of the bend angle, the length of the bending, and the offset of the workpiece with respect to a center of the machine.

10. The numerical control device according to any of claim 1, 2 or 3, wherein said memory further stores instructions for comparing a measured bend angle with a desired bend angle.

11. The numerical control device according to claim 10, wherein said memory further stores instructions for correcting the penetration depth if the result of the comparison is that the measured angle is different from the desired angle.

12. The numerical control device according to claim 11, wherein said memory further stores instructions for updating data in the memory according to the result of the correction to the penetration depth.

13. The numerical control device according to claim 11, wherein said memory further stores instructions for writing an additional group of data containing said input data and the corrected penetration depth.

14. The numerical control device according to any of claim 1, 2 or 3, wherein said memory further stores instructions for displaying at least one of a measured bend angle and a desired bend angle.

15. The numerical control device according to any of claim 1, 2 or 3, wherein said memory further stores instructions for indicating whether a measured angle lies within a certain tolerance range with respect to a desired bend angle.

16. The numerical control device according to any of claim 1, 2 or 3, wherein said bending conditions of said input data and of each group of stored data include a thickness of a workpiece, and said memory further stores instructions for searching, when said input data is not stored in the memory device, in the same group of data, whether there exists two groups of data having the same bending conditions as those input by the keyboard, except with regard to the thickness of the workpiece and respective workpiece thickness between which the workpiece thickness of said input data lies, and for calculating a penetration depth according to the penetration depths belonging to the two groups of stored data, respectively.

17. A press brake system, comprising:

a first beam and a second beam, one of which receives a punch and the other receives a die;

a movement producer that produces a relative movement between the punch and the die; and the numerical control device according to any of claim 1, 2 or 3, that controls the movement producer in order to produce a relative movement between the punch and the die.

* * * * *

UNITED STATES PATENT AND TRADEMARK OFFICE

CERTIFICATE OF CORRECTION

PATENT NO. : 6,651,472 B2
DATED : November 25, 2003
INVENTOR(S) : B. Chebbi

It is certified that error appears in the above-identified patent and that said Letters Patent is hereby corrected as shown below:

Column 14,
Lines 25-26, “keyboards” should be -- keyboard, --.

Column 15,
Lines 7, 11 and 39, “claim” should be -- claims --.

Column 16,
Lines 12, 17, 21 and 40, “claim” should be -- claims --.

Signed and Sealed this

Twenty-second Day of June, 2004

JON W. DUDAS
*Acting Director of the United States Patent and Trademark Office*